US006618870B2

(12) United States Patent
Farias

(10) Patent No.: US 6,618,870 B2
(45) Date of Patent: Sep. 16, 2003

(54) FOOT WASHER

(76) Inventor: Luis Farias, 5245 Almont St., Los Angeles, CA (US) 90032

( * ) Notice: Subject to any disclaimer, the term of this patent is extended or adjusted under 35 U.S.C. 154(b) by 54 days.

(21) Appl. No.: 09/909,954

(22) Filed: Jul. 21, 2001

(65) Prior Publication Data

US 2003/0015226 A1 Jan. 23, 2003

(51) Int. Cl.[7] ..... A47K 3/022
(52) U.S. Cl. ..... 4/605; 4/615; 134/199
(58) Field of Search ..... 134/199, 99.2; 239/436, 442, 550, 566; 4/597, 599, 601, 605, 611, 615, 903; 607/82; 604/150

(56) References Cited

U.S. PATENT DOCUMENTS 743,623 A * 11/1903 Dinneen
2,654,894 A * 10/1953 Van Dijck
3,292,185 A * 12/1966 Lucian
3,858,252 A * 1/1975 Ejchorszt
4,099,522 A * 7/1978 Alenares
4,485,503 A * 12/1984 Rolando et al. ..... 4/622
5,173,972 A * 12/1992 Goodman ..... 4/615 X
5,920,926 A * 7/1999 Torres ..... 4/611 X
5,920,927 A * 7/1999 Thomas ..... 4/599
6,079,060 A * 6/2000 Walker ..... 4/601

* cited by examiner

*Primary Examiner*—Philip R. Coe
(74) *Attorney, Agent, or Firm*—Clement Cheng

(57) ABSTRACT

The invention is a foot washer comprising; a coupler valve capable of attachment to a shower outlet, a main hose coupled with the coupler valve to allow feeding of water from the coupler valve through the main hose, a hollow frame capable of receiving a flow of water from a main hose, one or more nozzles capable of spraying water from the hollow frame, whereby a user placing a foot near the frame can receive a foot washing.

8 Claims, 2 Drawing Sheets

FOOT WASHER

BACKGROUND

Footwashers have been commonly used in bath and showers. Traditional foot washers are brush oriented. Probst U.S. Pat. No. 5,321,867 shows a brush in a frame housing that a user puts his feet into to scrub. Feet are brushed on the bottom front and sides. Another embodiment is Carlin U.S. Pat. No. 5,163,200 that is a scrubber for a foot with a brush for a heel. A washboard design is also possible. Willoby U.S. Pat. No. 4,003,372, is a washboard for feet that a user uses to massage and wash feet.

More eccentric designs include Giannetti U.S. Pat. No. 4,215,491 comprising boots that hold water inside the boot. Water runs off the legs and into the boot so that a user can soak feet while showering. Further improvements include Hogan U.S. Pat. No. 5,813,078 that shows a brush that emits soap when the brush is stepped on and being used. Rolando U.S. Pat. No. 4,485,503 is a standalone foot washer that automatically washes feet. It is like a washing machine for feet.

Footwashers are useful for older persons so that they do not have to bend over or risk slipping and falling in the tub when washing their feet.

OBJECT OF THE INVENTION

It is an object of the invention to have a foot washer that can wash feet better than prior foot washers.

DESCRIPTION OF THE PREFERRED EMBODIMENT

The invention is a device for has a line coming from the showerhead with soap attachment so that the user does not have to bend over to wash feet.

In most baths have showerheads to produce a stream or spray of water. The showerhead is commonly connected to a showerhead outlet defined herein as the portion where water exits the plane of the wall. The showerhead outlet can be used as a source of water. A hose attached to the outlet or a coupler 12 attached to a hose 9 can be used to direct flow of water from the shower outlet.

Figure 3:
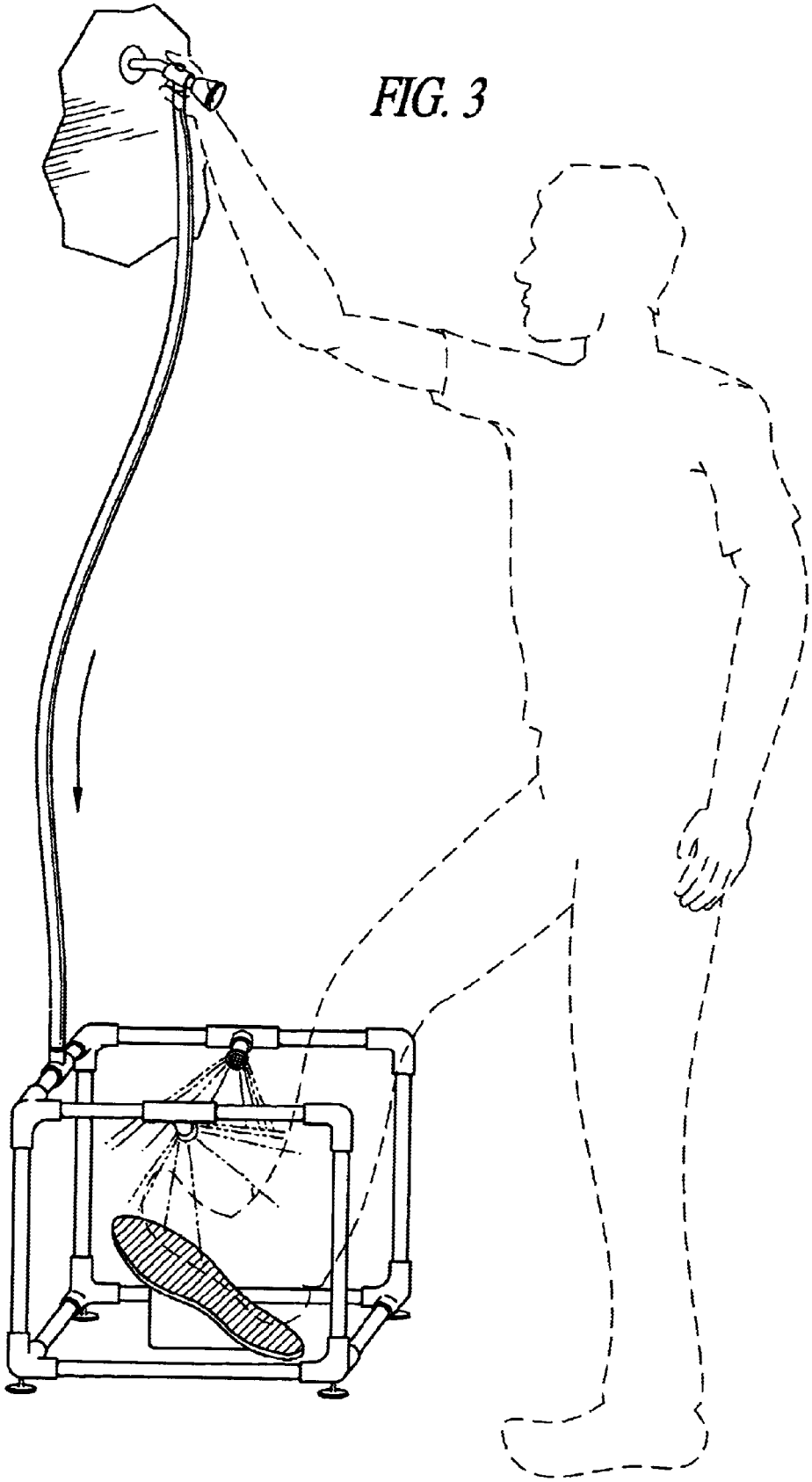
FIG. 3 is a view of a user in a shower operating the installed invention.

When a showerhead FIG. 3, 13 is attached to the shower, a person must first detach the showerhead and install either a hose 9 or a coupler. A coupler 12 can be used to direct the flow of water from a showerhead outlet. A hose can then be attached to a coupler and/or it can be attached directly to the showerhead outlet.

A coupler 12 is preferably constructed of stainless steel. It can direct water to a hose 9 attached to the coupler or it can direct water to a showerhead 13 attached to the coupler 12. It is preferred that a coupler 12 can be used so that a user can have greater control over apportionment of water flow between the showerhead and the foot washer. An alternative coupler design allows one to interrupt water flow to both the showerhead and the hose. The alternative design allows a coupler to act as a switch to turn off water flow.

The showerhead and coupler can also include an inlet capable of receiving a soap dispenser. The soap dispenser dispenses soap into the coupler where a stream of water flowing from the coupler through the hose turbulent mixes the water and the soap to create a soapy leather spray.

The soapy lather spray can be directed to a user's feet by means of a novel or a plurality of nozzles 5. The nozzles 5 attached to the hollow frame 10 are preferably constructed from PVC piping. PVC can be drilled with small holes to form a nozzle sprayer. The PVC piping provides both structure to retain the position of said plurality of nozzles 5 and provides a means to direct water to a user's feet.

The hollow structure is shaped to surround a user's feet or is shaped so that a nozzle can be directed to a user's foot when a user to this is his foot close to the whole structure. The hollow structure, coupler and hose can be packaged together as a kit. The kit can be sold at stores such, as hardware stores where a user purchases the kit and assembles the kit as a hobby project. A board 11 can be placed inside the enclosure formed by the hollow structure. The board is often very useful for use as a footrest.

The hollow structure can also be attached to the floor by means of suction cups 14, hook and loop tape, or other means commonly used to secure the hollow structure frame. The structural frame can be attached to the floor of a bathroom or the floor of a shower. The hollow structure can also be permanently attached to the structure of a building by means of screws, nails or other well-known attachment means. The structure can also stand-alone freely and unattached. It can be adapted to fit around or hang upon common bathroom structures such as the edge of a tub, or a faucet, or a soap holder such as a soap dish.

The do it yourself kit embodiment for user assembly may be comprised of the following parts.

Figure 1:
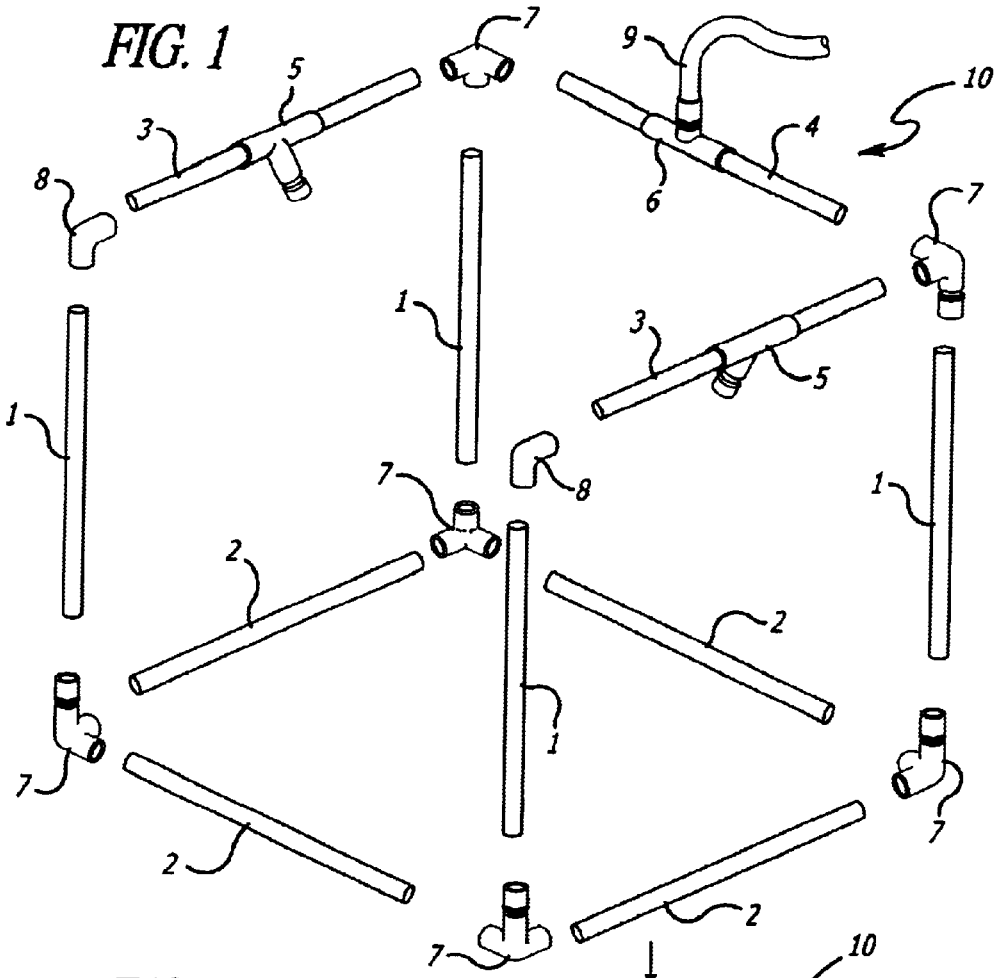
FIG. 1 is a perspective exploded view drawing of the best mode of the hollow frame.
Figure 2:
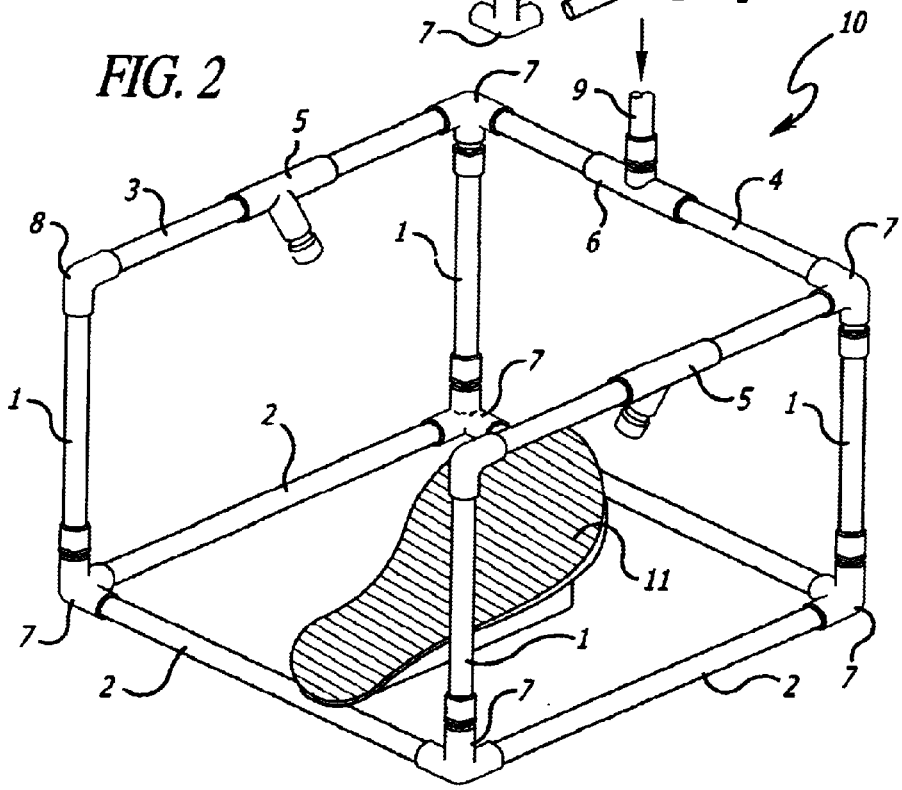
FIG. 2 is a perspective assembled drawing of the best mode of the hollow frame.

FIG. 1 shows an exploded view and easy assembly. A user may need PVC tools in addition to the parts. Some assembly may be required.

1. Vertical Retaining Pipe
2. Horizontal Retaining Pipe
3. Horizontal Retaining Pipe supporting water outlet
4. Horizontal Retaining Pipe supporting water receiver
5. Three way adaptor water outlet
6. Three way adaptor water receiver
7. Three way elbow joint
8. Two way elbow joint
9. Hose capable of feeding water
10. Hollow Frame (formed from the assemblage of parts)
11. Foot Rest (optional)
12. Coupler Valve
13. Shower Head (optional)
14. Suction Cups

What is claimed is:

1. A foot washer made of regular plumbing parts comprising:

a) a coupler valve capable of attachment to a shower outlet, b) a main hose coupled with said coupler valve to allow feeding of water from said coupler valve through said main hose, c) a hollow frame capable of receiving a flow of water from the main hose, wherein said hollow frame is formed of:

four vertical retaining pipes, each forming a vertical side of the hollow frame, four horizontal retaining pipes, each forming a side of the base of the hollow frame, two horizontal retaining pipes each supporting a water outlet, one horizontal retaining pipe supporting a water receiver and attached to the two horizontal retaining pipes supporting water outlets, two three way water adaptor outlets forming right angle perpendicular junctions, each three way water adaptor outlet attached to the midpoint of each horizontal retaining pipe supporting a water outlet, one three way water adaptor receiver attached to the midpoint of the one horizontal retaining pipe supporting a water receiver, six three way elbow joints forming right angle perpendicular junctions, four of the three way elbow joints joining the bottom four corners of the hollow frame and two three way elbow joints joining the top rear corners of the hollow frame, two two way elbow joints joining the top front corners of the hollow frame, d) two nozzles capable of spraying water from said hollow frame, each said three way water adaptor outlet feeding a nozzle, each nozzle directed at the top of a person's foot, whereby a user placing a foot in said frame can receive a foot washing.

2. A foot washer as in claim 1, wherein said coupler valve has an off position to interrupt the flow of water to said main hose and redirect water to the shower outlet, whereby a shower head emits water if it were attached to a shower outlet.

3. A foot washer as in claim 1, wherein said coupler valve has an variable position to apportion the flow of water between said main hose and the shower outlet.

4. A foot washer made of standard pipes and fittings comprising:

a) a main hose capable of attachment to a shower outlet, said main hose capable of receiving and directing a flow of water from said shower outlet, b) a hollow frame coupled to said main hose, said main hose directing a flow of water into a hollow portion of said hollow frame, said hollow frame capable of receiving a flow of water within said hollow portion, wherein said frame is formed of:

four vertical retaining pipes, each forming a vertical side of the hollow frame, four horizontal retaining pipes, each forming a side of the base of the hollow frame, two horizontal retaining pipes each supporting a water outlet, one horizontal retaining pipe supporting a water receiver and attached to the two horizontal retaining pipes supporting water outlets, two three way water adaptor outlets, each three way water adaptor outlet attached to the midpoint of each horizontal retaining pipe supporting a water outlet, one three way water adaptor receiver attached to the midpoint of the one horizontal retaining pipe supporting a water receiver, six three way elbow joints to form right angle perpendicular junctions, four of the three way elbow joints joining the bottom four corners of the hollow frame and two three way elbow joints joining the top rear corners of the hollow frame, two two way elbow joints forming right angle perpendicular junctions and joining the top front corners of the hollow frame, d) two nozzles having water spraying holes, each said three way water adaptor outlet feeding a nozzle, each nozzle directed at the top of a person's foot, whereby a user placing a foot in said frame can receive a foot washing.

5. An unassembled PVC foot washer kit made of regular plumbing parts for assembling a foot washer comprising:

a) a coupler valve capable of attachment to a shower outlet, b) a main hose couplable with said coupler valve to allow feeding of water from said coupler valve through said main hose, c) portions of PVC pipe and joints capable of assemblage to form a hollow frame capable of receiving a flow of water from the main hose, said hollow frame forming a partial enclosure, wherein said portions of PVC pipe and joints include:

four vertical retaining pipes, each to form a vertical side of the hollow frame, four horizontal retaining pipes, each forming a side of the base of the hollow frame, two horizontal retaining pipes each supporting a water outlet, one horizontal retaining pipe supporting a water receiver and attached to the two horizontal retaining pipes supporting water outlets, two three way water adaptor outlets, each three way water adaptor outlet attached to the midpoint of each horizontal retaining pipe supporting a water outlet, one three way water adaptor receiver attached to the midpoint of the one horizontal retaining pipe supporting a water receiver, six three way elbow joints to form right angle perpendicular junctions, four of the three way elbow for joining the bottom four corners of the hollow frame and two three way elbow joints for joining the top rear corners of the hollow frame, two two way elbow joints to form fight angle perpendicular junctions, for joining the top front corners of the hollow frame, d) two nozzles having water spraying holes, each said three way water adaptor outlet feeding a nozzle, each nozzle directed at the top of a person's foot, whereby upon assembly a user placing a foot in said frame receives a foot washing.

6. A PVC foot washer kit of claim 5, wherein said portions of PVC further include a foot rest.

7. A PVC foot washer kit of claim 5, wherein said portions of PVC further include a shower head.

8. A PVC foot washer kit of claim 5, wherein said portions of PVC further a pack of suction cups.

* * * * *